US009028190B2

(12) United States Patent
Kimura et al.

(10) Patent No.: US 9,028,190 B2
(45) Date of Patent: May 12, 2015

(54) BOOKBINDING APPARATUS

(71) Applicants: Kuniaki Kimura, Tokyo (JP); Kenichi Watanabe, Tokyo (JP)

(72) Inventors: Kuniaki Kimura, Tokyo (JP); Kenichi Watanabe, Tokyo (JP)

(73) Assignee: Gradco Japan Ltd., Shinagawa-ku, Tokyo (JP)

( * ) Notice: Subject to any disclaimer, the term of this patent is extended or adjusted under 35 U.S.C. 154(b) by 202 days.

(21) Appl. No.: 13/773,752

(22) Filed: Feb. 22, 2013

(65) Prior Publication Data

US 2013/0272819 A1 Oct. 17, 2013

(30) Foreign Application Priority Data

Apr. 13, 2012 (JP) ..... 2012-91998
Apr. 13, 2012 (JP) ..... 2012-92003
Apr. 13, 2012 (JP) ..... 2012-92008

(51) Int. Cl.
*B42B 5/08* (2006.01)
*B42B 5/10* (2006.01)

(52) U.S. Cl.
CPC ..... *B42B 5/103* (2013.01)

(58) Field of Classification Search
CPC ..... B42B 5/08; B42B 5/10; B42B 5/103
USPC ..... 412/6–7, 38–40; 308/412
See application file for complete search history.

(56) References Cited

U.S. PATENT DOCUMENTS

| | | | | |
|---|---|---|---|---|
| 5,464,312 | A * | 11/1995 | Hotkowski et al. | 412/40 |
| 5,615,986 | A * | 4/1997 | Cox | 412/40 |
| 2008/0075560 | A1 * | 3/2008 | Kurabayashi et al. | 412/38 |
| 2009/0257846 | A1 * | 10/2009 | Matsushita et al. | 412/6 |
| 2010/0119334 | A1 * | 5/2010 | Fuchs | 412/39 |
| 2012/0070250 | A1 * | 3/2012 | Ando et al. | 412/6 |
| 2012/0076616 | A1 * | 3/2012 | Satsukawa | 412/7 |

* cited by examiner

*Primary Examiner* — Kyle Grabowski
(74) *Attorney, Agent, or Firm* — Flynn, Thiel, Boutell & Tanis, P.C.

(57) ABSTRACT

A bookbinding apparatus inserts ring parts of a comb-shaped ring into binding holes of a sheet bundle and files and binds the sheet bundle, sequentially and includes a binding hole forming section configured to form binding holes in the sheet, a compiling section configured to arrange the sheet in which the binding holes are formed to make the sheet bundle, a comb-shaped ring feeding section configured to feed the comb-shaped ring piece by piece, a binding section configured to receive the fed comb-shaped ring, insert the ring parts of the comb-shaped ring into the binding holes of the sheet bundle, and bind the sheet bundle, and a bound-book discharging section configured to transfer the sheet bundle bound by the binding section to a storage stacker.

10 Claims, 12 Drawing Sheets

BOOKBINDING APPARATUS

BACKGROUND OF THE INVENTION

1. Field of the Invention

The present invention relates to a bookbinding apparatus that inserts ring parts of a comb-shaped ring into binding holes of a sheet bundle and files and binds the sheet bundle.

2. Description of Related Art

For example, a sheet bundle is adapted to be bound by perforating quadrangular holes in the sheet bundle and inserting ring parts of a comb-shaped ring into the quadrangular holes. When the sheet bundle is bound using the comb-shaped ring, business and office machine that perforates the quadrangular holes suitable for a cross-sectional shape of the ring parts in the sheet bundle and opens the plurality of ring parts at one time is required.

A perforating business and office machine is applied so as to have a function of opening ring parts, and thus is made small, and furthermore can be used for perforation of an ordinary binder in addition to a comb-shaped ring. A jig integrated with a perforating punch is known (Patent Document 1.)

Patent Document 1: Japanese Patent Application Laid-Open No. 8-39497

SUMMARY OF THE INVENTION

In this perforating business and office machine, a large quantity of sheet bundles cannot be filed and bound in a short time. For example, there is a need to connect to a printer to file and bind copied sheets in large quantities in a short time.

The present invention is directed to a bookbinding apparatus that is connected to, for instance, a printer and is capable of automatically filing and binding sheet bundles in large quantities in a short time.

To solve the problem and to accomplish the object, the present invention is provided as follows.

The invention (1) provides a bookbinding apparatus, which inserts ring parts of a comb-shaped ring into binding holes of a sheet bundle and files and binds the sheet bundle. The bookbinding apparatus sequentially includes: on a sheet transfer path transferring a sheet, a binding hole forming section configured to form the binding holes in the sheet; a compiling section configured to arrange the sheet in which the binding holes are formed to make the sheet bundle; a comb-shaped ring feeding section configured to feed the comb-shaped ring piece by piece; a binding section configured to receive the fed comb-shaped ring, to insert the ring parts of the comb-shaped ring into the binding holes of the sheet bundle, and to bind the sheet bundle; and a bound-book discharging section configured to transfer the sheet bundle bound by the binding section to a storage stacker.

The invention (2) provides the bookbinding apparatus set forth in (1), wherein the binding section includes: a binding unit configured to receive the comb-shaped ring fed at the comb-shaped ring receiving position, to move to a sheet bundle receiving position of the compiling section to open the ring parts of the comb-shaped ring, to insert the ring parts of the comb-shaped ring into the binding holes of the sheet bundle, and to bind the sheet bundle; and a moving unit configured to reciprocate the binding unit between the comb-shaped ring receiving position and the sheet bundle receiving position.

The invention (3) provides the bookbinding apparatus set forth in (2), wherein the binding unit receives the comb-shaped ring fed at the comb-shaped ring receiving position, moves to the sheet bundle receiving position while opening the ring parts of the comb-shaped ring, and receives the sheet bundle in a state in which the ring parts of the comb-shaped ring are opened.

The invention (4) provides the bookbinding apparatus set forth in (2), wherein the binding unit receives the comb-shaped ring fed at the comb-shaped ring receiving position, moves to the sheet bundle receiving position after opening the ring parts of the comb-shaped ring, and receives the sheet bundle in a state in which the ring parts of the comb-shaped ring are opened.

The invention (5) provides the bookbinding apparatus set forth in any one of (2) to (4), wherein the binding unit includes: holding claw members inserted between the ring parts of the fed comb-shaped ring to hold the comb-shaped ring; opening/closing claw members inserted between the ring parts of the fed comb-shaped ring and moving to a position locked on the ring parts to open the ring parts; and a ring-part opening/closing mechanism configured to reciprocate the opening/closing claw members between an initial position at which the opening/closing claw members are inserted between the ring parts of the comb-shaped ring and an opening position at which the opening/closing claw members open the ring parts.

The invention (6) provides the bookbinding apparatus set forth in (1), wherein the comb-shaped ring feeding section includes: a cartridge configured to load a plurality of comb-shaped rings in longitudinal and transverse lines; an elevating unit configured to raise the comb-shaped rings stored in the cartridge one transverse line by one transverse line; and an outgoing unit configured to send out the comb-shaped rings of one transverse line of an uppermost stage among the comb-shaped rings stored in the cartridge one by one.

The invention (7) provides the bookbinding apparatus set forth in (6), wherein the comb-shaped ring feeding section sends out the comb-shaped rings by means of the outgoing unit based on detection information about the comb-shaped ring receiving position at which the binding section receives the fed comb-shaped ring.

The invention (8) provides the bookbinding apparatus set forth in (1), wherein the comb-shaped ring feeding section is configured so that a cartridge in which a plurality of comb-shaped rings are loaded in longitudinal and transverse lines is detachably installed thereon.

The invention (9) provides the bookbinding apparatus set forth in (6), wherein when the outgoing unit sends out all the comb-shaped rings of one transverse line of the uppermost stage, the elevating unit raises the one transverse line of comb-shaped rings stored in the cartridge.

The invention (10) provides the bookbinding apparatus set forth in (9), wherein: the outgoing unit includes an endless transfer unit disposed at a position that is opposite to and above the comb-shaped rings of one transverse line of the uppermost stage, outgoing claws installed on the endless transfer unit at predetermined intervals so as to be inserted between the comb-shaped rings of one transverse line of the uppermost stage, and a driving unit configured to drive the endless transfer unit; and the outgoing claws send out the comb-shaped rings of one transverse line of the uppermost stage by driving of the endless transfer unit one by one.

The invention (11) provides the bookbinding apparatus set forth in (1), wherein the sheet transfer path has a switchback route disposed in a front stage of the binding hole forming section, and the sheet sent from a printer is allowed to be introduced from opposite sides of an apparatus main body.

The invention (12) provides the bookbinding apparatus set forth in (1), wherein the binding section includes an extrusion unit that sends out the bound sheet bundle to the transfer part.

The invention (13) provides the bookbinding apparatus set forth in (1), wherein: the bound-book discharging section includes an endless transfer unit disposed between a position above the storage stacker and the binding section, transfer claws installed on the endless transfer unit, and a driving unit configured to drive the endless transfer unit; and the transfer claws transfer the sheet bundle bound by the binding section to the storage stacker by driving of the endless transfer unit.

With the aforementioned configurations, the present invention has advantageous effects as follows.

In the invention (1), the binding hole forming section, the compiling section, the comb-shaped ring feeding section, the binding section, and the bound-book discharging section are sequentially provided on the sheet transfer path transferring the sheet. Thus, the bookbinding apparatus is connected to, for instance, a printer and is capable of automatically filing and binding sheet bundles in large quantities in a short time.

In the invention (2), the bookbinding apparatus is configured to receive the comb-shaped ring fed at the comb-shaped ring receiving position, to move to a sheet bundle receiving position of the compiling section to open the ring parts of the comb-shaped ring, to insert the ring parts of the comb-shaped ring into the binding holes of the sheet bundle, and to bind the sheet bundle. Thereby, the bookbinding apparatus is connected to, for instance, a printer and is capable of filing and binding sheet bundles in large quantities in a short time.

In the invention (3), the bookbinding apparatus is configured to receive the comb-shaped ring fed at the comb-shaped ring receiving position, to move to the sheet bundle receiving position while opening the ring parts of the comb-shaped ring, and to receive the sheet bundle in a state in which the ring parts of the comb-shaped ring are opened. Thereby, the ring parts of the comb-shaped ring are opened during the movement. As such, an opening time can be reduced, and bookbinding efficiency is improved.

In the invention (4), the bookbinding apparatus is configured to receive the comb-shaped ring fed at the comb-shaped ring receiving position, to move to the sheet bundle receiving position after opening the ring parts of the comb-shaped ring, and to receive the sheet bundle in a state in which the ring parts of the comb-shaped ring are opened. Thereby, the comb-shaped ring can be received and moved reliably.

In the invention (5), the bookbinding apparatus is configured to reciprocate the opening/closing claw members between an initial position at which the opening/closing claw members are inserted between the ring parts of the comb-shaped ring and an opening position at which the opening/closing claw members open the ring parts. Thus, the sheet bundle can be filed and bound reliably.

In the invention (6), the bookbinding apparatus is configured to send out the comb-shaped rings of one transverse line of an uppermost stage among the comb-shaped rings stored in the cartridge one by one. Thereby, when the comb-shaped ring is automatically fed, the bookbinding apparatus is connected to, for instance, a printer and is allowed to file and bind the sheet bundle in large quantities in a short time.

In the invention (7), the bookbinding apparatus is configured to send out the comb-shaped rings by means of the outgoing unit based on detection information about the comb-shaped ring receiving position at which the binding section receives the fed comb-shaped ring. Thereby, the comb-shaped ring can be reliably fed to the binding section.

In the invention (8), the comb-shaped ring feeding section configured to feed the comb-shaped ring to the binding section piece by piece is provided, and is detachably provided with a cartridge in which a plurality of comb-shaped rings are loaded in longitudinal and transverse lines. Thereby, the cartridge can be exchanged.

In the invention (9), the bookbinding apparatus is configured to send out all the comb-shaped rings of one transverse line of the uppermost stage, and to raise the one transverse line of comb-shaped rings stored in the cartridge. Thereby, the comb-shaped rings stored in the cartridge can be reliably fed to the binding section one by one.

In the invention (10), the outgoing claws send out the comb-shaped rings of one transverse line of the uppermost stage by driving of the endless transfer unit one by one. Thereby, the comb-shaped rings can be reliably fed to the binding section in a simple structure.

In the invention (11), the sheet transfer path has a switchback route disposed in a front stage of the binding hole forming section, and the sheet sent from a printer is allowed to be introduced from opposite sides of an apparatus main body. Thereby, the bookbinding apparatus can be connected to various printers and file and bind the sheet bundle in large quantities in a short time.

In the invention (12), the sheet bundle bound by the binding section can be sent out to the bound-book discharging section, and reliably transferred to the storage stacker.

In the invention (13), the endless transfer unit is driven, and thereby the transfer claws can reliably transfer the sheet bundle bound by the binding section to the storage stacker.

DETAILED DESCRIPTION OF EMBODIMENTS

A bookbinding apparatus according to an embodiment of the invention will be described below. Although the embodiment of the present invention shows a most preferable mode, the present invention is not limited thereto.

Figure 1:
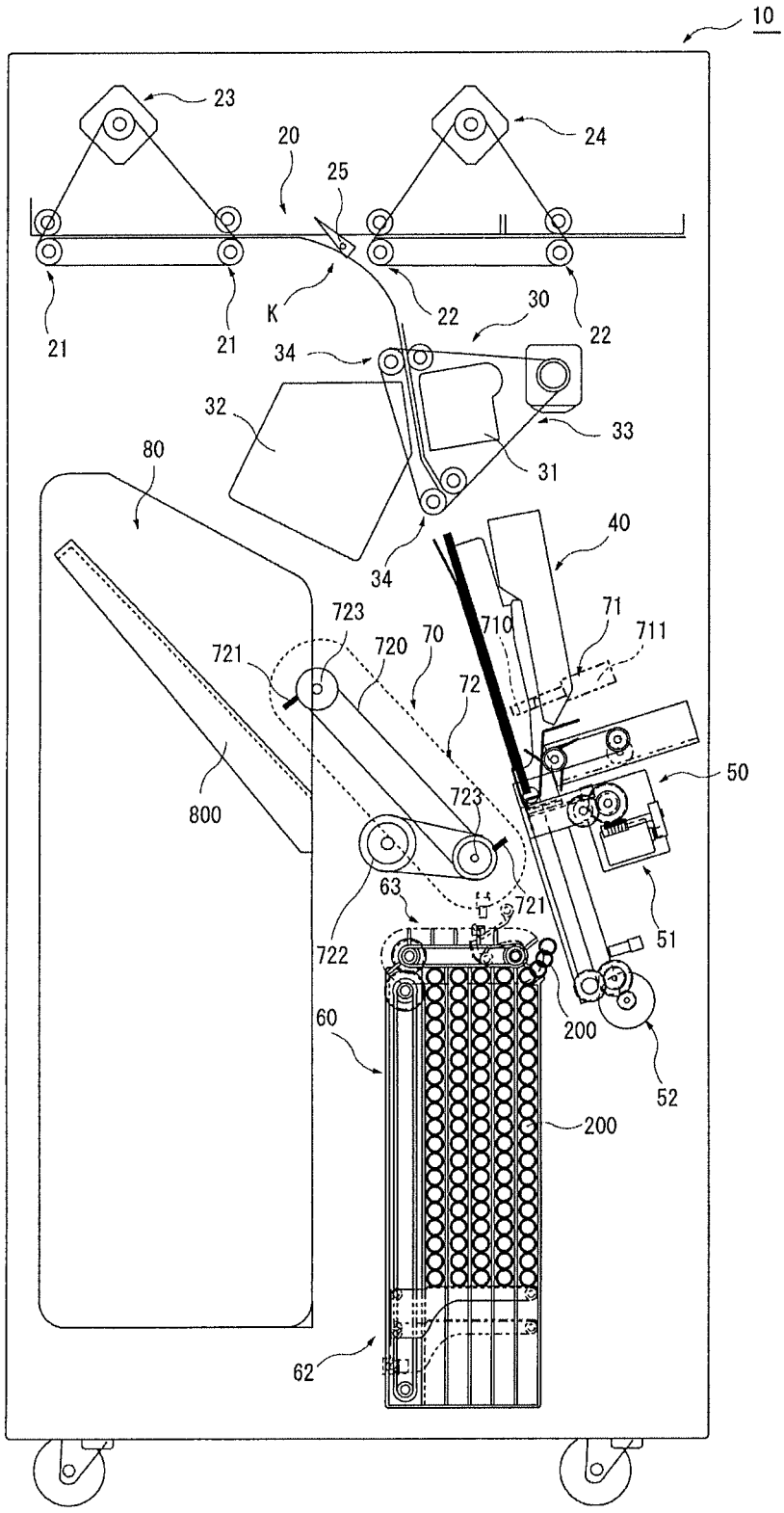
FIG. 1 is a view illustrating a schematic configuration of a bookbinding apparatus.
Figure 2:
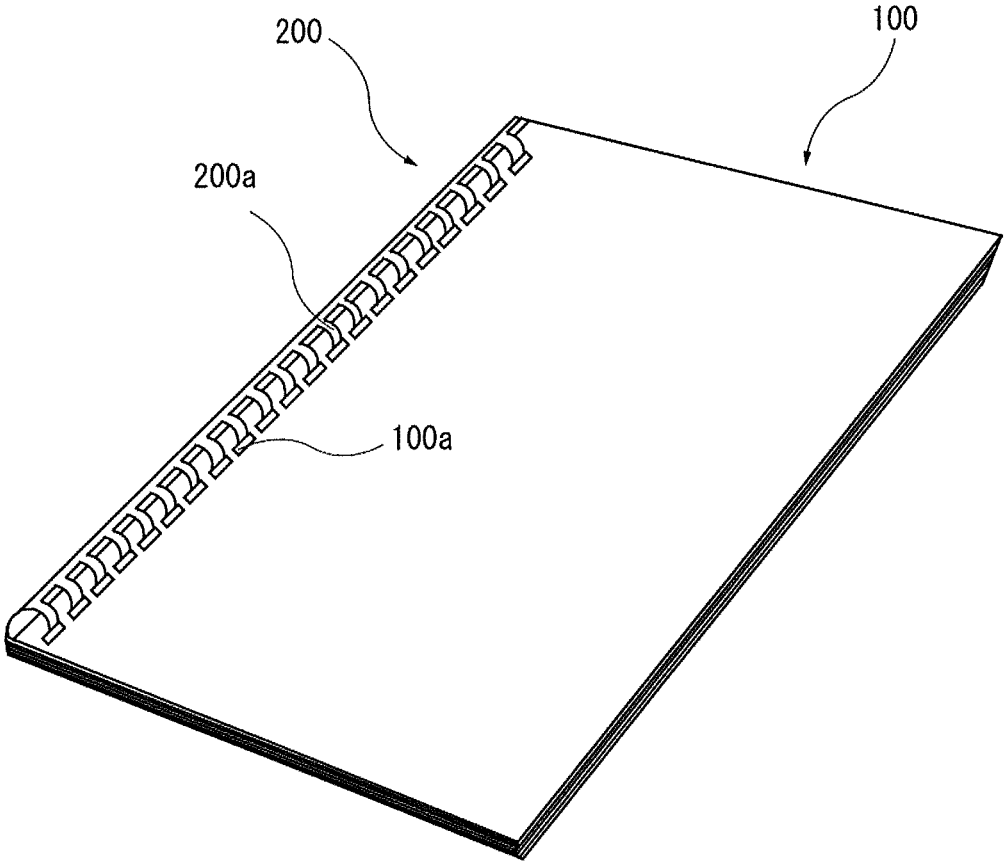
FIG. 2 is a perspective view illustrating a state in which a sheet bundle is filed and bound.
Figure 3:
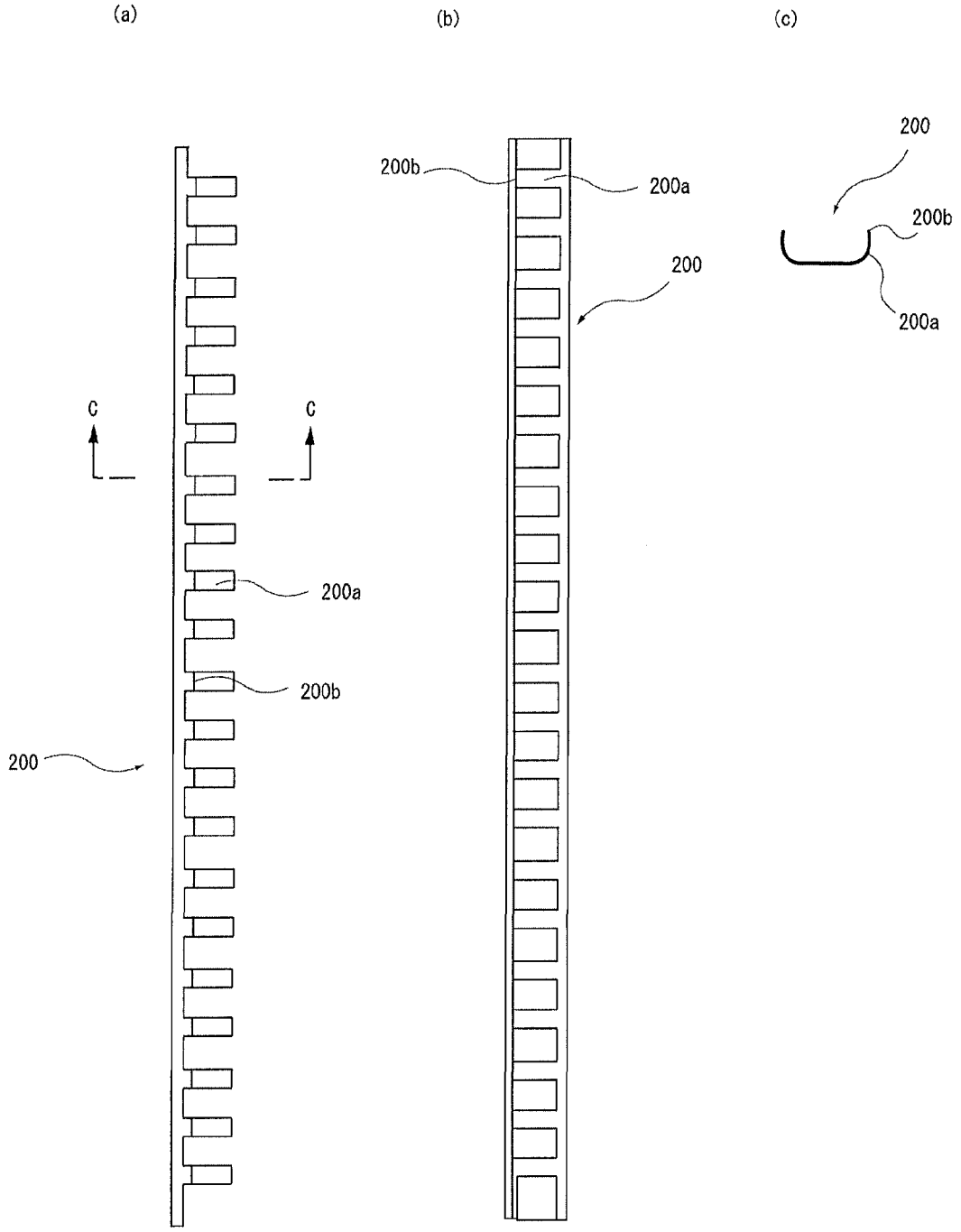
FIG. 3 is a view illustrating a comb-shaped ring.
Figure 4:
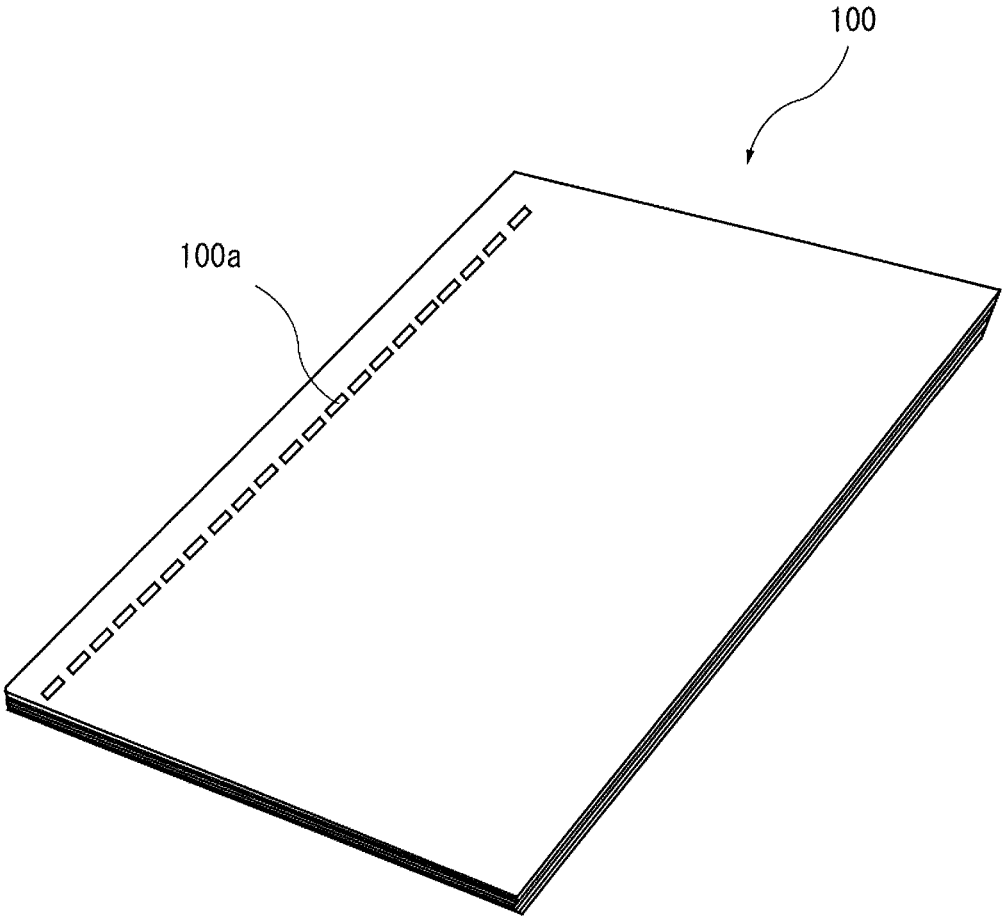
FIG. 4 is a view illustrating sheets in which binding holes are formed.
Figure 5:
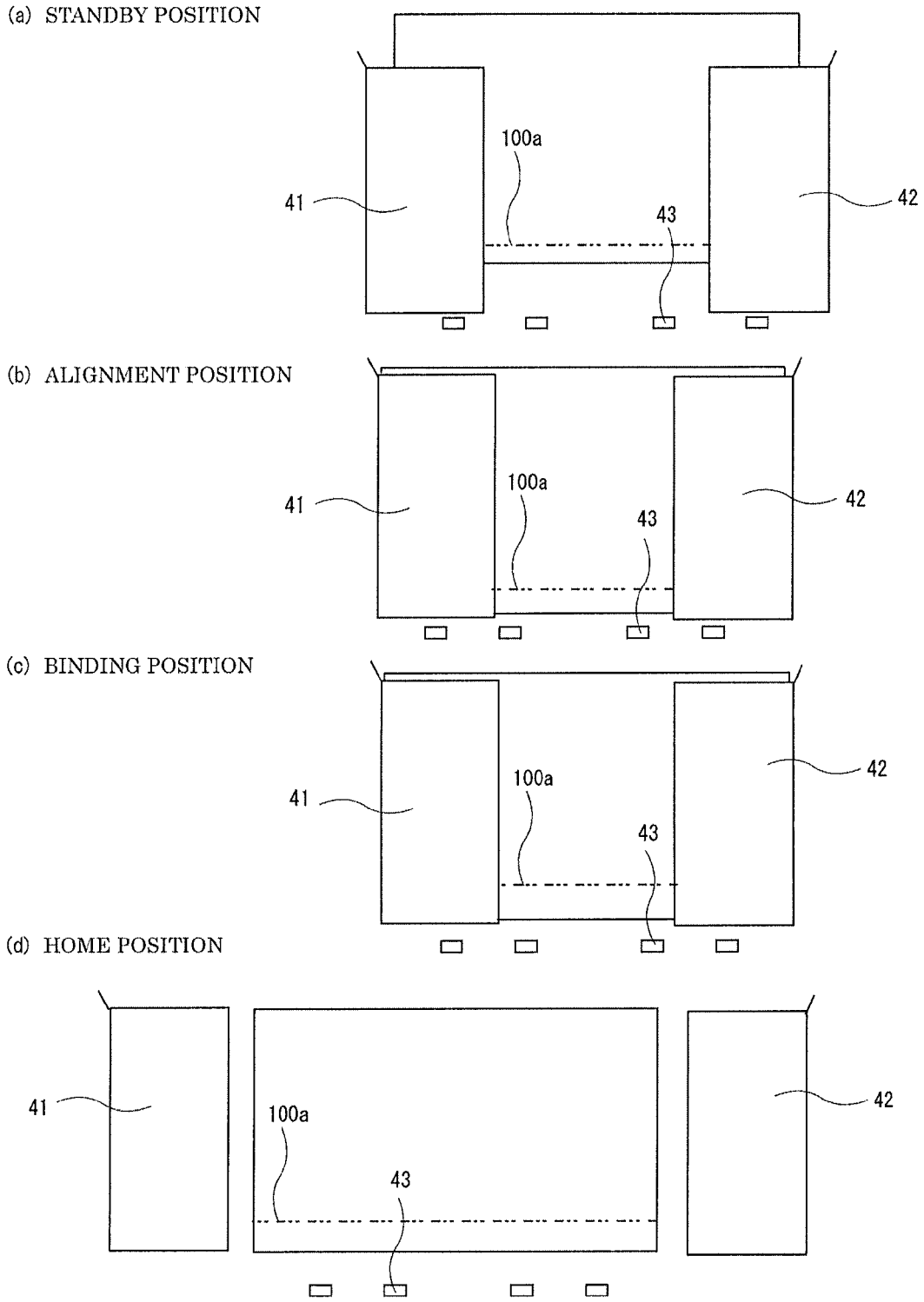
FIG. 5 is a view describing an operation of arranging the sheets of a compiling section.

The bookbinding apparatus of the present embodiment will be described based on FIGS. 1 to 12. FIG. 1 is a view illustrating a schematic configuration of the bookbinding apparatus. FIG. 2 is a perspective view illustrating a state in which a sheet bundle is filed and bound. FIG. 3 is a view illustrating a comb-shaped ring. FIG. 4 is a view illustrating sheets in which binding holes are formed. FIG. 5 is a view describing an operation of arranging the sheets of a compiling section.

Figure 6:
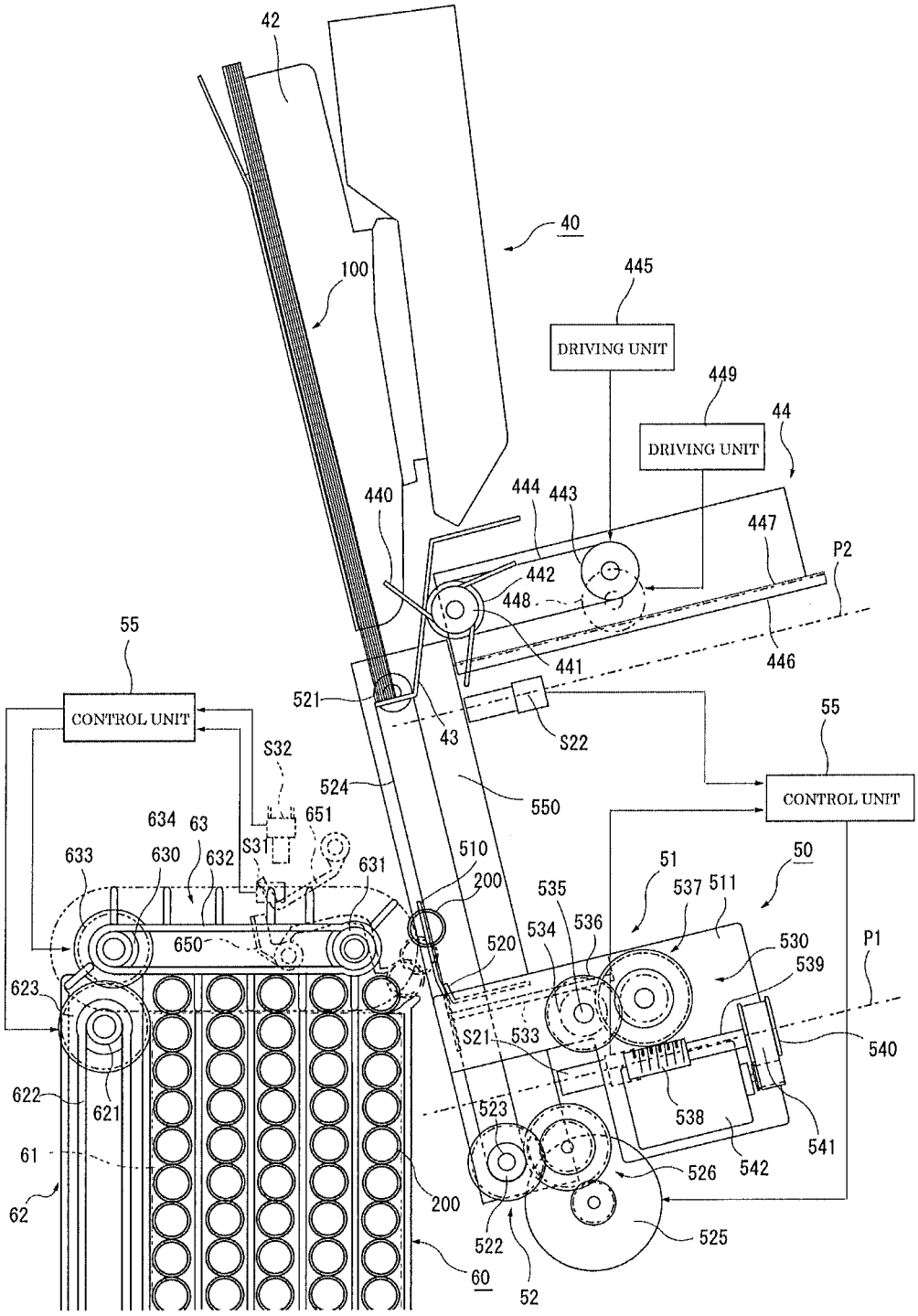
FIG. 6 is a view illustrating a state of a comb-shaped ring receiving position of a binding section.
Figure 7:
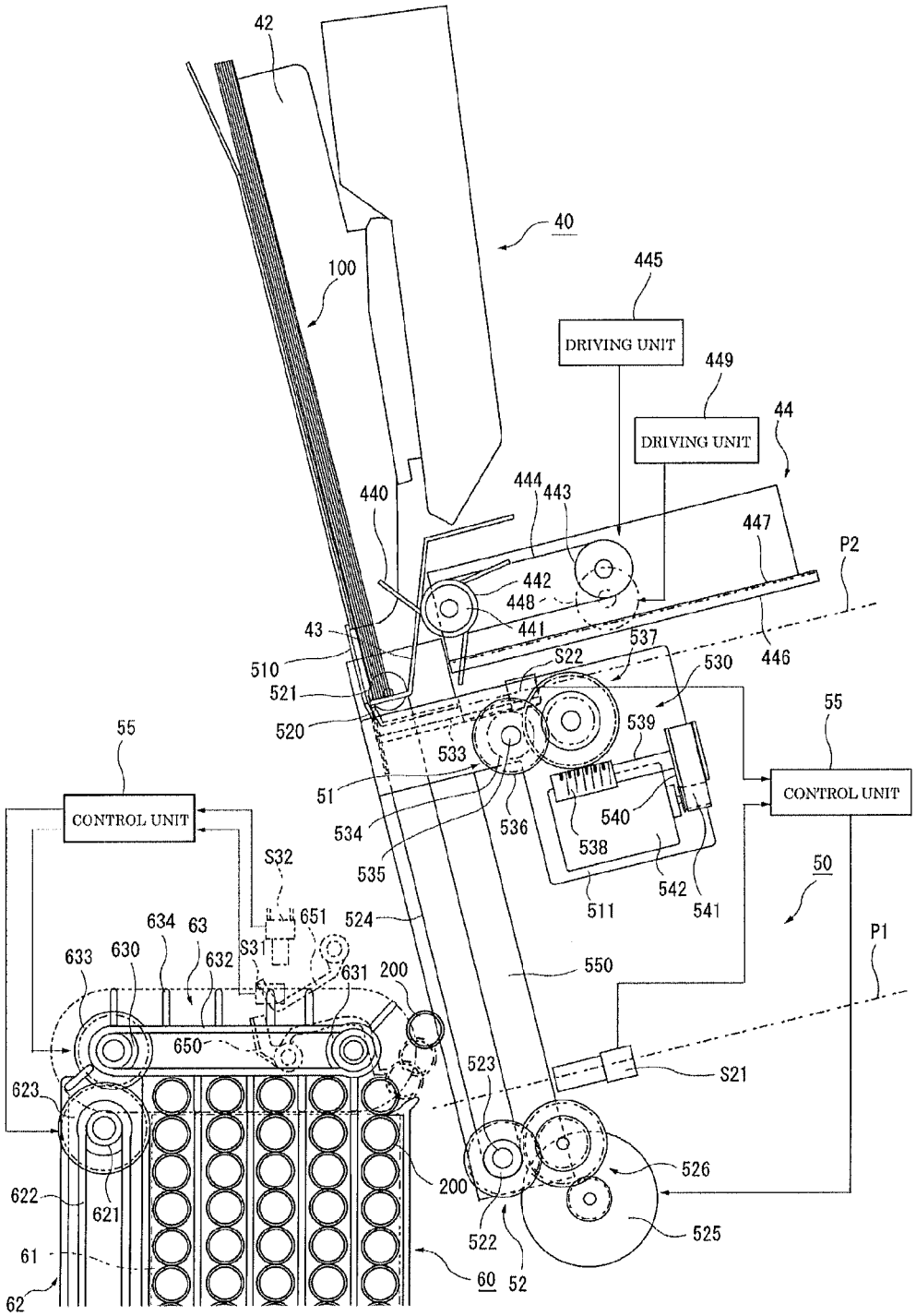
FIG. 7 is a view illustrating a state of a sheet bundle receiving position of the binding section.
Figure 8:
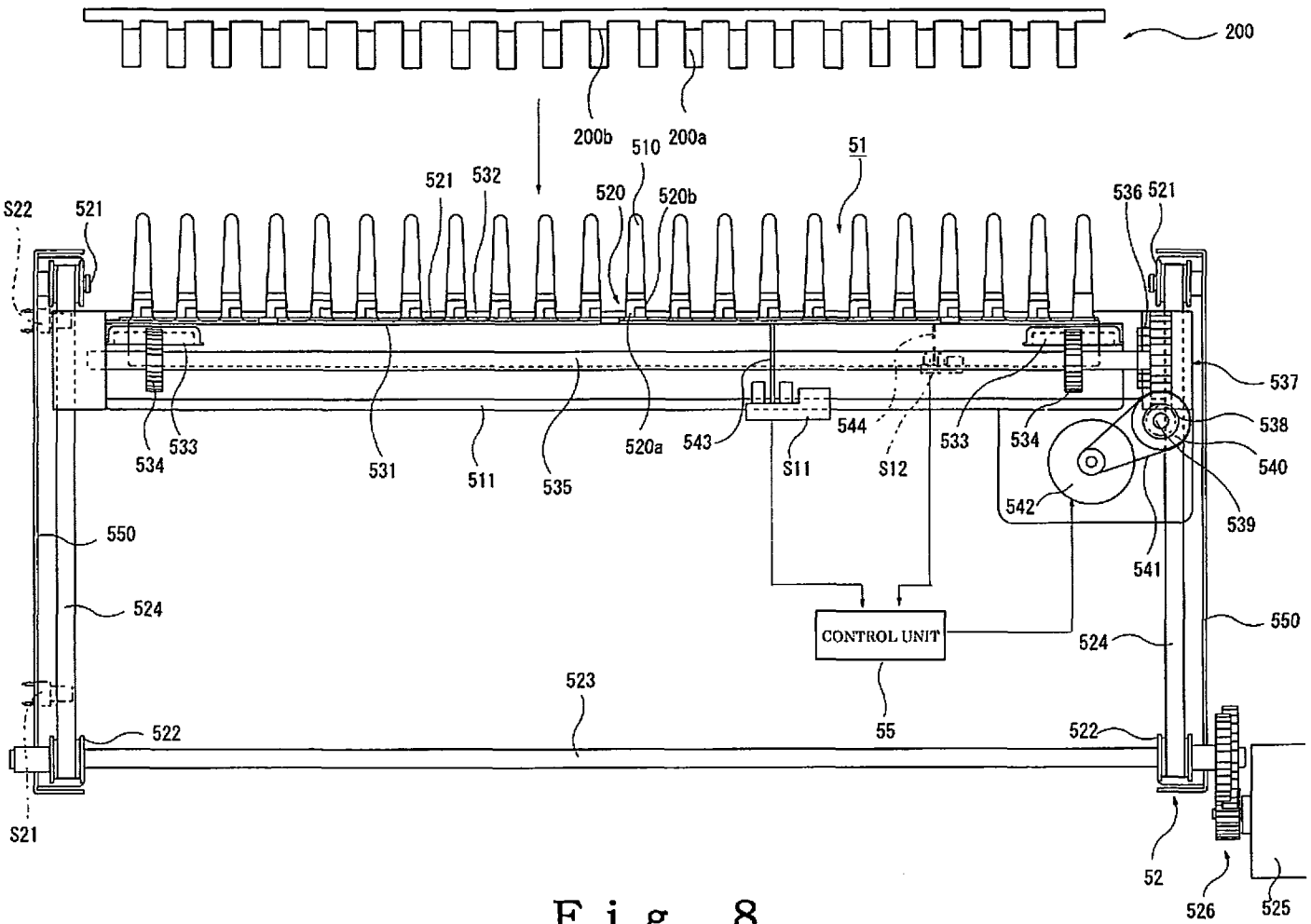
FIG. 8 is a plan view of the binding section.
Figure 9:
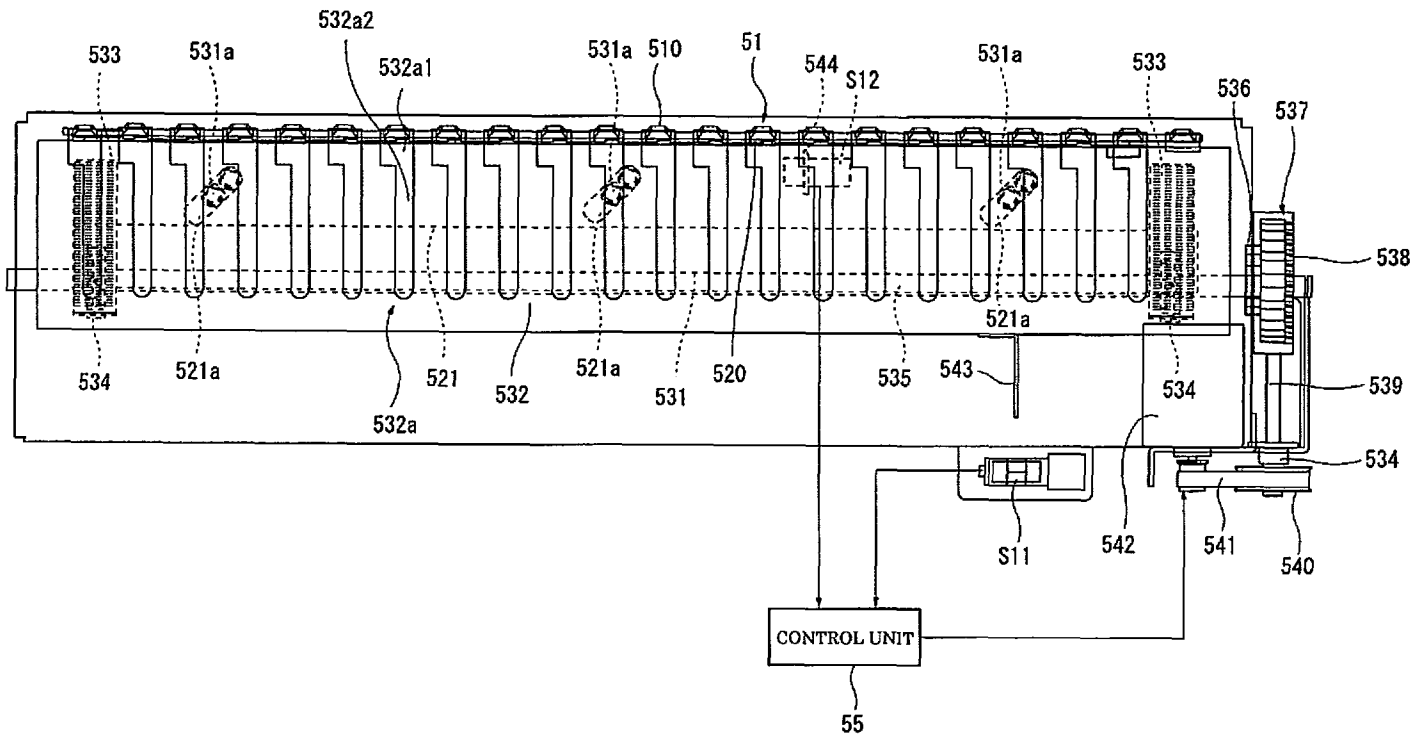
FIG. 9 is a front view of the binding section.
Figure 10:
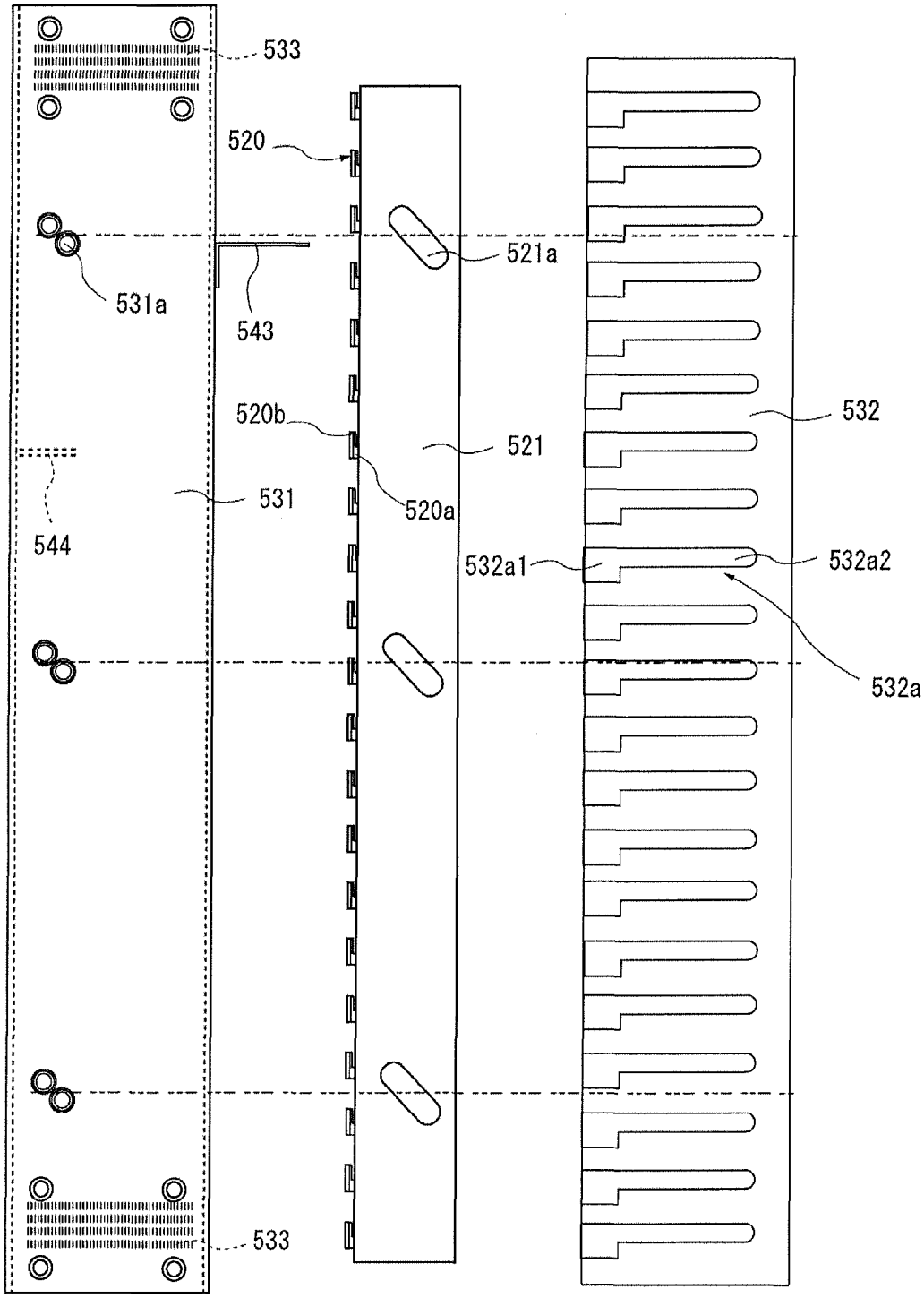
FIG. 10 is a view illustrating a configuration of a cam mechanism that opens ring parts of the comb-shaped ring.
Figure 11:
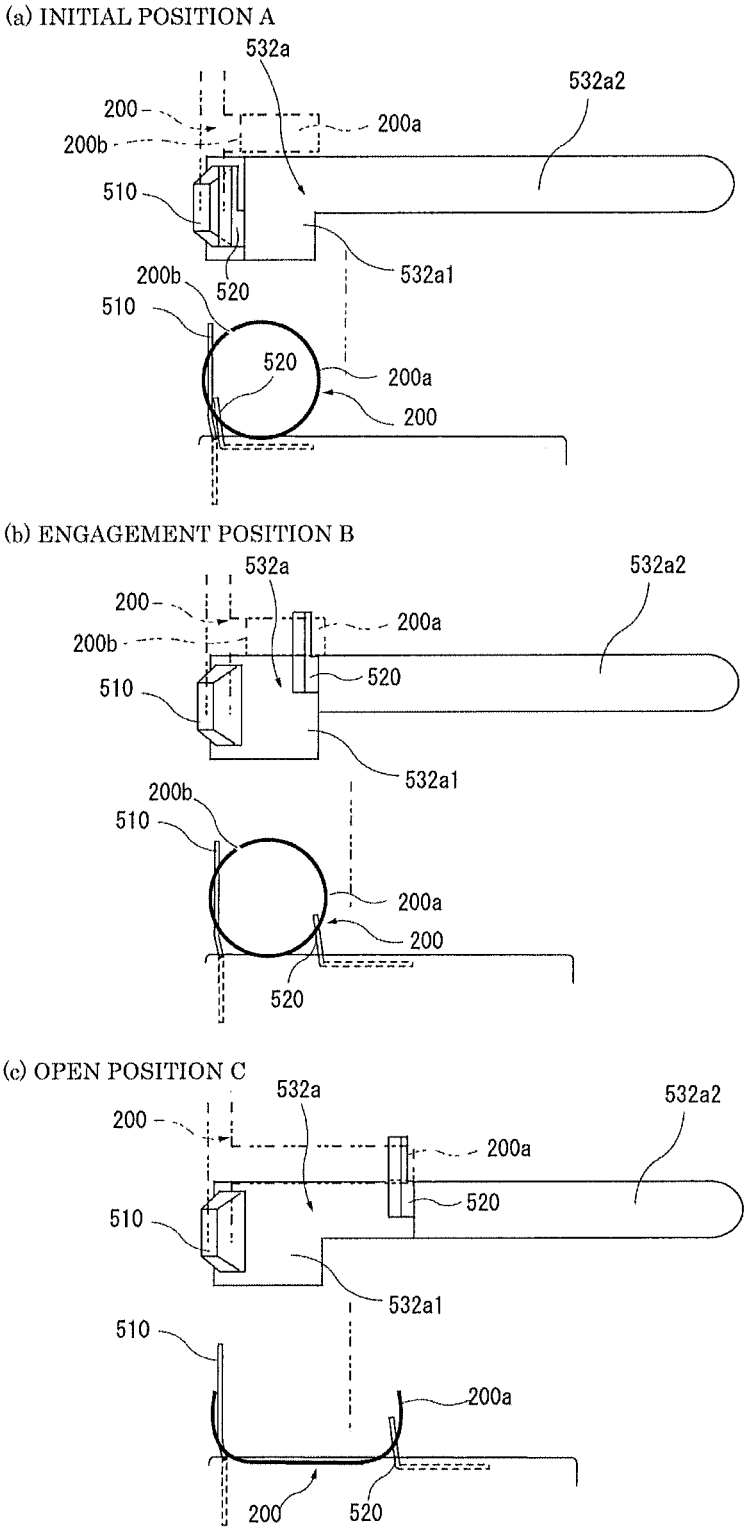
FIG. 11 is a view illustrating an operation of opening the ring parts of the comb-shaped ring by a cam mechanism.
Figure 12:
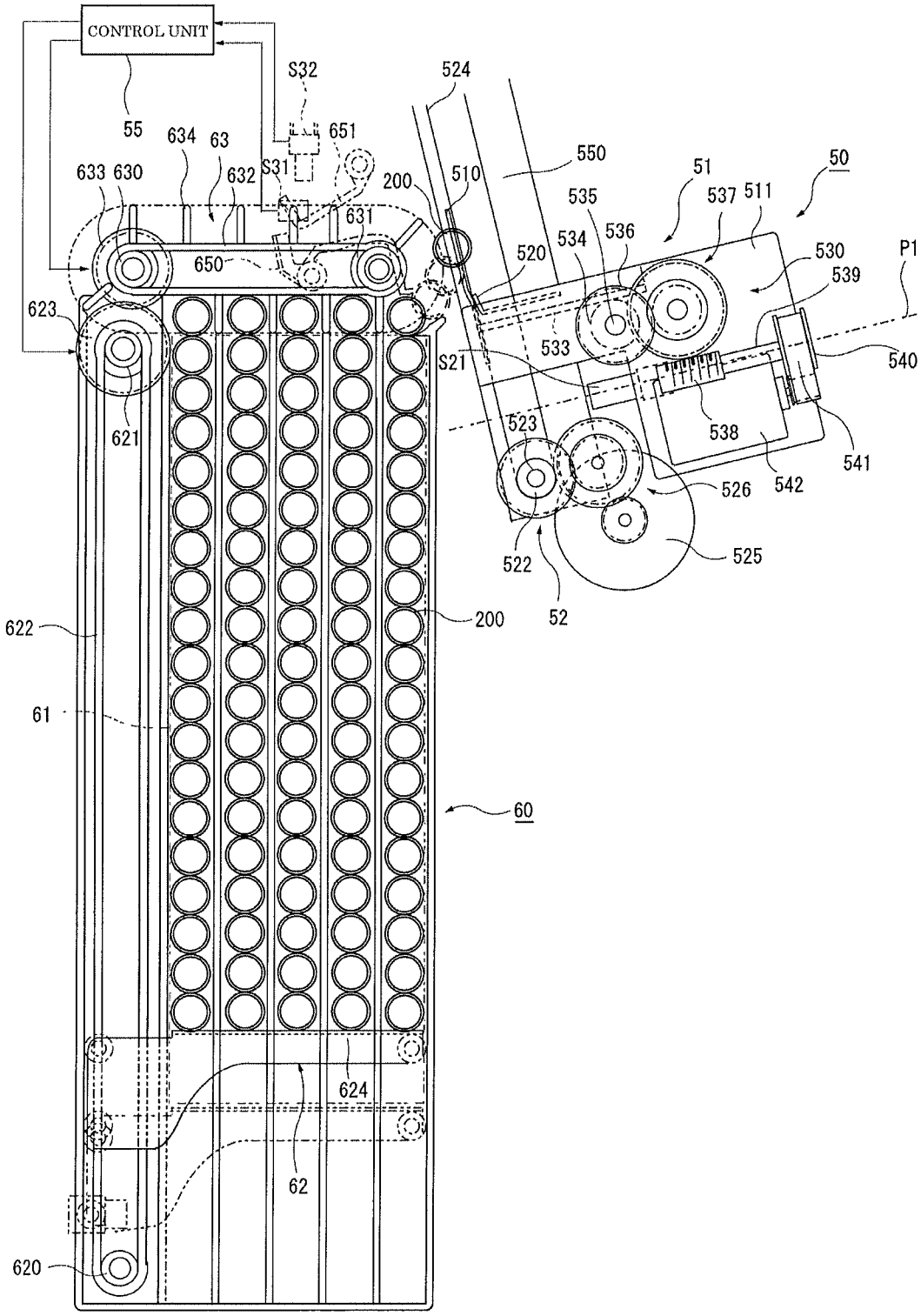
FIG. 12 is a view illustrating a comb-shaped ring fed state of a comb-shaped ring feeding section.

FIG. 6 is a view illustrating a state of a comb-shaped ring receiving position of a binding section. FIG. 7 is a view illustrating a state of a sheet bundle receiving position of the binding section. FIG. 8 is a plan view of the binding section. FIG. 9 is a front view of the binding section. FIG. 10 is a view illustrating a configuration of a cam mechanism that opens ring parts of the comb-shaped ring. FIG. 11 is a view illustrating an operation of opening the ring parts of the comb-shaped ring. FIG. 12 is a view illustrating a comb-shaped ring fed state of a comb-shaped ring feeding section.

A bookbinding apparatus 10 of the present embodiment includes a sheet transfer path 20, a binding hole forming section 30, a compiling section 40, a binding section 50, a comb-shaped ring feeding section 60, a bound-book discharging section 70, and a storage stacker 80. As shown in FIG. 2, the bookbinding apparatus 10 is configured to insert ring parts 200*a* of a comb-shaped ring 200 into binding holes 100*a* formed in sheets of a sheet bundle 100, and to file and bind the sheet bundle 100. As shown in FIG. 3, the comb-shaped ring 200 is configured so that the ring parts 200*a* are integrally formed of resin at predetermined intervals in an axial direction, and so that the ring parts 200*a* are allowed to be opened/closed by notches 200*b* formed at bases.

Configuration of Sheet Transfer Path

The sheet transfer path 20 is provided with a binding hole forming section 30, a compiling section 40, a binding section 50, and a bound-book discharging section 70 in sequence. Transfer rollers 21 are disposed on a left side of the sheet transfer path disposed at an upper side of an apparatus main body, and transfer rollers 22 are disposed on a right side of the sheet transfer path. The transfer rollers 21 are driven by a roller driving unit 23, and the transfer rollers 22 are driven by a roller driving unit 24. Thus, the sheet sent from a printer is allowed to be carried in from both sides of the apparatus main body. A gate 25 is disposed between the left-hand transfer rollers 21 and the right-hand transfer rollers 22.

When the sheet is carried in from the left side of the apparatus main body, the roller driving unit 23 and the roller driving unit 24 drive the transfer rollers 21 and the transfer rollers 22 so as to transfer the sheet from the left side toward the right side. The sheet is sent to the binding hole forming section 30 via the gate 25, and the unnecessary sheet is discharged to the right side by horizontally switching the gate 25. When the sheet is carried in from the right side of the apparatus main body, the gate 25 is switched in a horizontal direction, and the roller driving unit 23 and the roller driving unit 24 drive the transfer rollers 21 and the transfer rollers 22 so as to transfer the sheet from the right side toward the left side. When the sheet goes through the gate 25, the gate 25 is switched, and the sheet is switched back by reverse rotation of the left-hand transfer rollers 21 and is sent to the binding hole forming section 30. The unnecessary sheet when the sheet is carried in from the right side of the apparatus main body is discharged to the left side by continuing forward rotation of the transfer rollers 21.

In this way, by disposing a switchback route K based on the gate 25 on the sheet transfer path 20, the sheet sent from the printer is allowed to be carried in from the apparatus main body, and to be sent to the binding hole forming section 30 with a binding part side of the sheet adopted as a leading end side.

Configuration of Binding Hole Forming Section

The binding hole forming section 30 is disposed on a stage next to the switchback route K, and includes a punch unit 31 and a dust box 32. As shown in FIG. 4, the punch unit 31 forms the binding holes 100*a* in binding parts of the sheet, drives transfer rollers 34 using a roller driving unit 33, and sends the sheet, in which the binding holes 100*a* are formed, to the compiling section 40. The binding holes 100*a* are formed by punching the sheet, and wastepaper generated by the punching is stored in the dust box 32.

Configuration of Compiling Section

As shown in FIGS. 5 to 7, the compiling section 40 includes a front jogger 41, a rear jogger 42, an end fence 43, and a paddle unit 44. The paddle unit 44 is configured so that paddles 440 are installed on a rotating shaft 441, a belt 444 spans between a pulley 442 of the rotating shaft 441 and a driving pulley 443, the driving pulley 443 is rotated by a driving unit 445 made up of a speed reducer and a driving motor, and the sheets sent to the compiling section 40 by the paddles 440 are aligned.

When the sheet is transferred to the compiling section 40, the front jogger 41 and the rear jogger 42 are located at a standby position (FIG. 5(*a*)). In a state in which the sheet is stored in the compiling section 40 and is supported on the end fence 43, the sheet moves to an alignment position (FIG. 5(*b*)), and is subjected to a matching operation. This is repeated to align a predetermined number of sheets. The sheets are subjected to a final matching operation, and move to a binding position (FIG. 5(*c*)). After the binding is carried out, the sheets move to a home position (FIG. 5(*d*)). The binding section 50 inserts the ring parts 200*a* of the comb-shaped ring 200 into the binding holes 100*a* formed in the sheets of the sheet bundle 100, and binds the sheet bundle to send it to the bound-book discharging section 70. Both the front jogger 41 and the rear jogger 42 complete the movement to the standby position (FIG. 5(*a*)), and then the next sheet is sent to the compiling section 40.

Configuration of Binding Section

As shown in FIGS. 6 to 11, the binding section 50 receives the comb-shaped ring 200 fed from the comb-shaped ring feeding section 60 piece by piece along with the sheet bundle 100 from the compiling section 40, inserts the ring parts 200*a* of the comb-shaped ring 200 into the binding holes 100*a* of the sheets, and files and binds the sheets.

The binding section 50 includes a binding unit 51 and a moving unit 52. The binding unit 51 receives the comb-shaped ring 200 fed at a ring binder receiving position P1, and moves to a sheet bundle receiving position P2 to open the ring parts 200*a* of the comb-shaped ring 200. In this state, the binding unit 51 receives the sheet bundle 100, inserts the ring parts 200*a* of the comb-shaped ring 200 into the binding holes 100*a* of the sheet bundle 100, and binds the sheets. The moving unit 52 reciprocates the binding unit 51 between the comb-shaped ring receiving position P1 and the sheet bundle receiving position P2. Configurations of the binding unit 51 and the moving unit 52 will be described in detail.

The binding unit 51 includes holding claw members 510, opening/closing claw members 520, and a ring-part opening/closing mechanism 530. Each holding claw member 510 protrudes along an end of a holder body 511 and is installed in one body. A space of the holding claw members 510 is set so as to be able to be inserted between the ring parts 200*a* of the comb-shaped ring 200. The holding claw members 510 are inserted into the ring parts 200*a* of the fed comb-shaped ring 200, and hold the comb-shaped ring 200.

Each opening/closing claw member 520 protrudes along an end of a movable plate 521, and is installed in one body. A space of the opening/closing claw members 520 is set so as to be able to be inserted between the ring parts 200*a* of the comb-shaped ring 200. Each opening/closing claw member 520 includes a rising part 520*a* and a curved part 520*b*. The curved part 520*b* has almost the same width as the holding claw member 510, and is set so as to be able to be inserted between the ring parts 200*a* of the comb-shaped ring 200 along with the holding claw member 510. The opening/closing claw members 520 are inserted between the ring parts 200*a* of the fed comb-shaped ring 200, move to a position at which they are locked on the ring parts 200*a*, and operate so as to open the ring parts 200*a*.

The ring-part opening/closing mechanism 530 includes a movable plate 521, a driving plate 531, and a guide plate 532. The movable plate 521 is disposed on the driving plate 531, and the guide plate 532 is disposed on the movable plate 521. The opening/closing claw members 520 are integrally formed at an end of the movable plate 521, and a cam hole 521*a* is formed in a middle portion of the movable plate 521 at three places. A cam pin 531*a* is formed in a middle portion of the driving plate 531 at three places. The cam holes 521*a* are engaged so as to be able to move in contact with the cam pins 531*a*. When the driving plate 531 moves forward or backward, the movable plate 521 is adapted to move.

The guide plate 532 is formed with guide grooves 532*a*. Each guide groove 532*a* has a wide width part 532*a*1 and a narrow width part 532*a*2. The wide width part 532*a*1 faces the holding claw member 510, and is formed with almost the same width as the holding claw member 510. The narrow width part 532*a*2 extends from the wide width part 532*a*1 in a direction separated from the holding claw member 510. As the movable plate 521 moves, the opening/closing claw member 520 moves along the guide groove 532*a*.

The driving plate 531 is formed with racks 533 on left and right sides of a lower side thereof. A pinion 534 is meshed with the rack 533. The pinion 534 is fixed to a driving shaft 535. Opposite ends of the driving shaft 535 are pivotably supported on the holder body 511. A driving gear 536 is fixed to one of the opposite ends. The driving gear 536 is meshed with a worm gear 538 via a speed reducer 537. A pulley 540 installed on a worm gear shaft 539 is connected to a driving motor 542 via a belt 541. A driving force of the driving motor 542 is transmitted to the belt 541, the pulley 540, the worm gear shaft 539, the worm gear 538, the speed reducer 537, the driving gear 536, and the driving shaft 535, and rotates the pinion 534. Thereby, the driving plate 531 moves forward or backward via the racks 533.

The opening/closing claw members 520 are located at an initial position A that is the same position as the holding claw members 510 (FIG. 11(*a*)). When the driving plate 531 moves backward by driving of the driving motor 542, the cam pins 531*a* move in contact with the cam holes 521*a*. Thereby, the movable plate 521 moves the opening/closing claw members 520 in a direction that is engaged with the ring parts 200*a* of the comb-shaped ring 200 along the wide width parts 532*a*1 of the guide grooves 532*a*. The opening/closing claw members 520 move from an engaging position B at which they are engaged with the ring parts 200*a* of the comb-shaped ring 200 (FIG. 11(*b*)) in a direction in which they open the ring parts 200*a* of the comb-shaped ring 200 along the narrow width parts 532*a*2 of the guide grooves 532*a*, and are stopped at an open position C at which the ring parts 200*a* are opened (FIG. 11(*c*)). The stopping of the opening/closing claw members 520 is performed by stopping the driving of the driving motor 542 when a sensor S11 detects a detecting flag 543 installed on the driving plate 531. Thereby, the opening/closing claw members 520 open the ring parts 200*a* of the comb-shaped ring 200.

At the open position C at which the opening/closing claw members 520 open the ring parts 200*a* of the comb-shaped ring 200 (FIG. 11(*c*)), the driving plate 531 moves forward by the driving of the driving motor 542, and the cam pins 531*a* move in contact with the cam hole 521*a*. Thereby, the movable plate 521 moves the opening/closing claw members 520 along the narrow width parts 532*a*2 of the guide grooves 532*a*, and closes the ring parts 200*a* of the comb-shaped ring 200. The opening/closing claw members 520 return to the engaging position B at which they are engaged with the ring parts 200*a* of the comb-shaped ring 200 (FIG. 11(*b*)). Moreover, when the driving plate 531 moves forward, the cam pins 531*a* move in contact with the cam holes 521*a*. Thereby, the movable plate 521 moves the opening/closing claw members 520 along the wide width parts 532*a*1 of the guide grooves 532*a* in a direction in which the opening/closing claw members 520 are disengaged from the ring parts 200*a* of the comb-shaped ring 200. The opening/closing claw members 520 return to the initial position A that is the same position as the holding claw members 510 (FIG. 11(*a*)), close the ring parts 200*a* of the comb-shaped ring 200, and are stopped. The stopping of the opening/closing claw members 520 is performed by stopping the driving of the driving motor 542 when a sensor S12 detects a detecting flag 544 installed on the driving plate 531. In this way, based on detection information of the sensor S11 and the sensor S12, a control unit 55 controls the driving motor 542, and reciprocates the opening/closing claw members 520 between the initial position A at which the opening/closing claw members 520 are inserted between the ring parts 200*a* of the comb-shaped ring 200 and the open position C at which the opening/closing claw members 520 open the ring parts 200*a*. Thereby, the ring parts 200*a* of the comb-shaped ring 200 are inserted and bound into the binding holes 100*a* of the sheets.

The moving unit 52 is configured so that a pair of left and right driven rollers 521 are installed on upper portions of a pair of left and right support frames 550, and so that a pair of driving rollers 522 are installed on opposite ends of a driving shaft 523 at lower portions of the support frames. Belts 524 are put across the driven rollers 521 and the driving rollers 522, and a driving motor 525 rotates the driving shaft 523 via a transmission mechanism 526.

The holder body 511 is disposed between the pair of left and right belts 524. Opposite ends of the holder body 511 are fixed to the belts 524, and the driving motor 525 is driven to rotate the driving shaft 523 via the transmission mechanism 526. Thereby, the driving shaft 523 is configured so as to be raised or lowered by the belts 524. Based on detection information of a sensor S21 and a sensor S22, the control unit 55 controls the driving motor 525, and reciprocates the binding unit 51 between the comb-shaped ring receiving position P1 and the sheet bundle receiving position P2.

In this way, the moving unit 52 reciprocates the binding unit 51 between the comb-shaped ring receiving position P1 and the sheet bundle receiving position P2, and the binding unit 51 receives the comb-shaped ring 200 fed at the comb-shaped ring receiving position P1, moves to the sheet bundle receiving position P2 to receive the sheet bundle in a state in which the ring parts 200*a* of the comb-shaped ring 200 are opened, inserts the ring parts 200*a* of the comb-shaped ring 200 into the binding holes 100*a* of the sheet bundle, and binds the sheet bundle.

When the binding unit 51 is configured to receive the comb-shaped ring 200 fed at the comb-shaped ring receiving position P1, to move to the sheet bundle receiving position P2 while opening the ring parts 200*a* of the comb-shaped ring 200, and to receive the sheet bundle in the state in which the ring parts 200*a* of the comb-shaped ring 200 are opened, the ring parts 200*a* of the comb-shaped ring 200 are opened during the movement. As such, an opening time can be reduced, and bookbinding efficiency is improved.

Further, the binding unit 51 can be configured to receive the comb-shaped ring 200 fed at the comb-shaped ring receiving position P1, to open the ring parts 200*a* of the comb-shaped ring 200 at the comb-shaped ring receiving position P1, and then to move to the sheet bundle receiving position P2 to receive the sheet bundle in the state in which the ring parts 200*a* of the comb-shaped ring 200 are opened, and is allowed to move so as to reliably receive the comb-shaped ring 200.

Configuration of Comb-Shaped Ring Feeding Section

A comb-shaped ring feeding section 60 includes a cartridge 61, an elevating unit 62, and an outgoing unit 63, and feeds the comb-shaped ring 200 to the binding section 50 piece by piece. The binding section 50 receives the fed comb-shaped ring 200 at the comb-shaped ring receiving position P1.

The cartridge 61 is configured to load a plurality of comb-shaped rings 200 in longitudinal and transverse lines, is detachably installed on the comb-shaped ring feeding section 60, and is exchanged with the new cartridge 61 when the stored comb-shaped rings 200 are used up.

The elevating unit 62 is configured so that a belt 622 spans between an upper pulley 620 and a lower pulley 621, and so that the upper pulley 621 is rotated by a driving motor 623 that is a driving unit. A lifting plate 624 is fixed to the belt 622, and raises the comb-shaped rings 200 stored in the cartridge 61 by driving of the driving motor 623 one transverse line by one transverse line.

The outgoing unit 63 is configured so that a belt 632 that is an endless transfer unit is put across a pair of left and right pulleys 630 and 631, and so that the belt 632 is rotated by a driving motor 633 via the pair of pulleys 630 and 631. The belt 632 is disposed at a position that is opposite to and above the comb-shaped rings 200 of one transverse line of the uppermost stage. Outgoing claws 634 are installed on the belt 632 at predetermined intervals so as to be inserted between the comb-shaped rings 200 of one transverse line of the uppermost stage. The belt 632 is driven, and thus the outgoing claws 634 send out the comb-shaped rings 200 of one transverse line of the uppermost stage one by one.

The comb-shaped ring feeding section 60 is configured so that, based on the detection information of the comb-shaped ring receiving position P1 at which the binding section 50 receives the fed comb-shaped ring 200, the control unit 55 drives the driving motor 633, and thus to rotate the belt 632 to send out one comb-shaped ring 200 by means of the outgoing claws 634. The comb-shaped ring 200 is sent out, and thereby a detection lever 650 is operated. A sensor S31 detects the outgoing of the comb-shaped ring 200, and sends the detection information to the control unit 55. Further, the outgoing claws 634 are rotated, and thereby the detection lever 651 is operated. A sensor S32 detects the outgoing of all the comb-shaped rings 200 of one transverse line of the uppermost stage, and sends the detection information to the control unit 55.

The control unit 55 drives the driving motor 623 of the elevating unit 62 based on the detection information of the sensor S32, raises the comb-shaped rings 200, which are stored in the cartridge 61 by the lifting plate 624 fixed to the belt 622, one transverse line by one transverse line, and lowers the lifting plate 624 when the comb-shaped rings 200 stored in the cartridge 61 are used up. Thus, the cartridge 61 is exchanged with a new cartridge.

In addition, the control unit 55 has control over the side of the printer. That is, the sensor (not shown) of the binding section 50 detects the decided remaining number of sheets (for example, five sheets), and immediately sends the detected result to the side of the printer. At the printer side, the binding section 50 is instructed to stop its operation by the determination corresponding to that. Further, for example, the side of the printer is informed of the occurrence of jamming of the sheet, the occurrence of component failure, the full loading of a loading tray 800 by the side of the bookbinding apparatus, and the stop and reset of the apparatus are controlled at the side of the printer. In this case, in the place in which the jamming of the sheet occurs or the failure occurs, the following operation is made impossible. In the full loading of the loading tray 800, as long as the instruction to "stop the operation" is not given from the side of the printer, the operation continues until it is physically stopped.

Configuration of Bound-Book Discharging Section

The bound-book discharging section 70 includes an extrusion unit 71 and a transfer unit 72, extrudes the sheet bundle, which is bound by the binding section 50, to the transfer unit 72 by means of the extrusion unit 71, and transfers it to the storage stacker 80. The extrusion unit 71 is supported on a support 446, moves forward by means of racks 447 and a pinion 448 which are integrated into a push lever 710, extrudes the book-bound sheet bundle to the transfer unit 72, and then moves backward to return to a standby position.

The transfer unit 72 is disposed between the storage stacker 80 and the binding section 50 at an upper side of the comb-shaped ring feeding section 60, and includes a belt 720 that is an endless transfer unit, transfer claws 721, and a driving motor 722 that is a driving unit. The belt 720 is put across a pair of pulleys 723 and 723, and the transfer claws 721 are installed on the belt 720. The belt 720 is driven by the driving motor 722. Thereby, the transfer claws 721 transfer the sheet bundle bound by the binding section 50 to the storage stacker 80.

The storage stacker 80 has the loading tray 800 installed so as to be able to move up and down. The loading tray 800 moves down while the book-bound sheet bundle is stacked on the loading tray 800, and a great deal of bookbinding can be performed.

INDUSTRIAL APPLICABILITY

The present invention can be applied to the bookbinding apparatus that inserts the ring parts of the ring binder into the binding holes of the sheet bundle and files and binds the sheet bundle. For example, the present invention may be connected to, for instance, a printer, and file and bind the sheet bundle in large quantities in a short time.

REFERENCE SIGNS LIST

10 bookbinding apparatus
20 sheet transfer path
21, 22 transfer rollers
23, 24 roller driving unit
25 gate
30 binding hole forming section
31 punch unit
32 dust box
33, 34 roller driving unit
40 compiling section
41 front jogger
42 rear jogger
43 end fence
44 paddle unit
50 binding section
51 binding unit
52 moving unit
60 comb-shaped ring feeding section

61 cartridge
62 elevating unit
63 outgoing unit
70 bound-book discharging section
71 extrusion unit
72 transfer unit
80 storage stacker
100 sheet bundle
100*a* binding holes
200 comb-shaped ring
200*a* ring parts
K switchback route
510 holding claw member
520 opening/closing claw member
521 movable plate
530 ring-part opening/closing mechanism
531 driving plate
532 guide plate
800 loading tray

The invention claimed is:

1. A bookbinding apparatus which inserts ring parts of a comb-shaped ring into binding holes of a sheet bundle and files and binds the sheet bundle, sequentially, comprising:

a sheet transfer path configured to transfer a sheet, a binding hole forming section configured to form the binding holes in the sheet;

a compiling section configured to arrange the sheet in which the binding holes are formed to make the sheet bundle;

a comb-shaped ring feeding section configured to feed the comb-shaped ring piece by piece;

a binding section configured to receive the fed comb-shaped ring, insert the ring parts of the comb-shaped ring into the binding holes of the sheet bundle and bind the sheet bundle; and a bound-book discharging section configured to transfer the sheet bundle bound by the binding section to a storage stacker, wherein the comb-shaped ring feeding section includes:

a cartridge configured to load a plurality of comb-shaped rings in longitudinal and transverse lines;

an elevating unit configured to raise the comb-shaped rings stored in the cartridge one transverse line by one transverse line; and an outgoing unit configured to send out the comb-shaped rings of one transverse line of an uppermost stage among the comb-shaped rings stored in the cartridge one by one, and the comb-shaped ring feeding section is configured to send out the comb-shaped rings by means of the outgoing unit based on detection information about the comb-shaped ring receiving position at which the binding section receives the fed comb-shaped ring.

2. The bookbinding apparatus according to claim 1, wherein the binding section includes:

a binding unit configured to receive the comb-shaped ring fed at the comb-shaped ring receiving position, move to a sheet bundle receiving position of the compiling section to open the ring parts of the comb-shaped ring, insert the ring parts of the comb-shaped ring into the binding holes of the sheet bundle, and bind the sheet bundle; and a moving unit configured to reciprocate the binding unit between the comb-shaped ring receiving position and the sheet bundle receiving position.

3. The bookbinding apparatus according to claim 2, wherein the binding unit is configured to receive the comb-shaped ring fed at the comb-shaped ring receiving position, move to the sheet bundle receiving position while opening the ring parts of the comb-shaped ring, and receive the sheet bundle in a state in which the ring parts of the comb-shaped ring are opened.

4. The bookbinding apparatus according to claim 2, wherein the binding unit is configured to receive the comb-shaped ring fed at the comb-shaped ring receiving position, move to the sheet bundle receiving position after opening the ring parts of the comb-shaped ring, and receive the sheet bundle in a state in which the ring parts of the comb-shaped ring are opened.

5. The bookbinding apparatus according to claim 2, wherein the binding unit includes:

holding claw members inserted between the ring parts of the fed comb-shaped ring configured to hold the comb-shaped ring;

opening/closing claw members inserted between the ring parts of the fed comb-shaped ring and moving to a position locked on the ring parts configured to open the ring parts; and a ring-part opening/closing mechanism configured to reciprocate the opening/closing claw members between an initial position at which the opening/closing claw members are inserted between the ring parts of the comb-shaped ring and an opening position at which the opening/closing claw members open the ring parts.

6. The bookbinding apparatus according to claim 1, wherein the comb-shaped ring feeding section is configured so that a cartridge in which a plurality of comb-shaped rings are loaded in longitudinal and transverse lines is detachably installed thereon.

7. The bookbinding apparatus according to claim 1, wherein, when the outgoing unit sends out all the comb-shaped rings of one transverse line of the uppermost stage, the elevating unit raises the one transverse line of comb-shaped rings stored in the cartridge.

8. The bookbinding apparatus according to claim 7, wherein the outgoing unit includes an endless transfer unit disposed at a position that is opposite to and above the comb-shaped rings of one transverse line of the uppermost stage, outgoing claws installed on the endless transfer unit at predetermined intervals so as to be inserted between the comb-shaped rings of one transverse line of the uppermost stage, and a driving unit configured to drive the endless transfer unit; and the outgoing claws configured to send out the comb-shaped rings of one transverse line of the uppermost stage by driving of the endless transfer unit one by one.

9. The bookbinding apparatus according to claim 1, wherein the sheet transfer path has a switchback route disposed in a front stage of the binding hole forming section, and the sheet sent from a printer is allowed to be introduced from opposite sides of an apparatus main body.

10. The bookbinding apparatus according to claim 1, wherein the binding section includes an extrusion unit configured to send out the bound sheet bundle to the transfer part.

* * * * *